United States Patent [19]

Hoke

[11] Patent Number: 5,003,795

[45] Date of Patent: Apr. 2, 1991

[54] LOCK PROTECTOR

[76] Inventor: A. Chyril Hoke, 207 E. Main, P.O. Box 212, Bainbridge, Ind. 46105

[21] Appl. No.: 402,493

[22] Filed: Sep. 1, 1989

[51] Int. Cl.[5] ..... E05B 67/38

[52] U.S. Cl. ..... 70/55; 70/455

[58] Field of Search ..... 70/54–56, 70/455, 424, DIG. 56; 292/DIG. 2, 251.1

[56] References Cited

U.S. PATENT DOCUMENTS

| | | | |
|---|---|---|---|
| 676,001 | 6/1901 | Jarvis . | |
| 1,055,865 | 3/1913 | Boll | 70/DIG. 56 X |
| 1,244,404 | 10/1917 | Ankovitz | 70/DIG. 56 X |
| 1,581,953 | 4/1926 | Jackson | 70/DIG. 56 X |
| 2,828,157 | 3/1958 | Fox et al. | 70/55 X |
| 3,434,318 | 3/1969 | Thiry | 70/455 |
| 3,718,014 | 2/1973 | Delgadillo | 70/56 |
| 3,782,149 | 1/1974 | Carter | 70/455 |
| 4,090,379 | 5/1978 | Lehner | 70/455 |
| 4,154,072 | 5/1979 | Flaschar | 70/455 |
| 4,218,902 | 8/1980 | Druschel | 70/55 |
| 4,226,104 | 10/1980 | Oliver | 70/455 |
| 4,286,445 | 9/1981 | Sills | 70/55 |
| 4,317,344 | 3/1982 | Barnard | 70/55 |
| 4,566,296 | 1/1986 | Kochakis | 70/56 |
| 4,674,308 | 6/1987 | Peters | 70/455 |
| 4,825,673 | 5/1989 | Drake | 70/455 |
| 4,858,454 | 8/1989 | McAnulty | 70/455 |

FOREIGN PATENT DOCUMENTS

| | | | |
|---|---|---|---|
| 355974 | 7/1922 | German Democratic Rep. | 70/55 |

*Primary Examiner*—Robert L. Wolfe

*Assistant Examiner*—Suzanne L. Dino

*Attorney, Agent, or Firm*—Woodard, Emhardt, Naughton Moriarty & McNett

[57] ABSTRACT

In one embodiment, a lock protector includes a front and back cover and a hinge portion formed from a single sheet of vinyl material. A hasp slot is formed in the back cover of the protector through which a hasp is inserted. The front and back covers include mutually contact adherent strips around the perimeter of the covers adapted to sealingly engage when the front cover is folded onto the back cover along the hinge portion with the lock situated within and attached to the hasp. Another embodiment is disclosed in which the lock protector includes a pouch defining a pocket for receiving the lock therein. The protector includes a flap extending from the pouch and adapted to overlay the opening of the pocket. The flap includes a hasp slot which is intersected by the hinge portion so that when the flap is folded over the pocket opening the hasp slot opens upward to receive the hasp. A number of contact adherent strips are provided on the flap for engaging the pouch and for engaging about the hinge portion. Another embodiment is disclosed for use with a flush-mounted lock that includes a base sheet, a flap and a hinge portion formed of a single sheet of material. The base sheet includes an access opening which can be centered around the keyhole of the lock to provde access to the keyhole. Contact adherent strips are provided on the perimeter of the base sheet and flap to close the lock protector about the keyhole of the flush-mounted lock.

18 Claims, 2 Drawing Sheets

LOCK PROTECTOR

BACKGROUND OF THE INVENTION

This invention relates to devices for protecting locks of various kinds, such as padlocks, cylinder locks and flush-mounted locks. In particular, the invention relates to a lock protector that completely covers and seals the lock to protect the lock and keyhole against invasion by the elements.

Locks are used in a wide variety of applications. For instance, padlocks can be used to lock a mailbox. In another example, each mailbox in an array of mailboxes may have its own flush-mounted lock with an exposed keyhole. Locks are also found on automobiles, such as the trunk lock which is also a flush mounted cylinder-type lock. In each of these applications, the lock and more particularly the keyhole, are often exposed to the elements. Water that invades the lock through the keyhole or through the shackle interface with a padlock body, can freeze within the lock, rendering it virtually useless until the water has thawed.

Thus, there is a need for a device to protect the lock against the elements and particularly against invasion by water. Certain devices have been proposed in the past for shielding various types of locks. These devices are illustrated in the following Patents; Jarvis, U.S. Pat. No. 676,001; Jackson, U.S. Pat. No. 1,581,953; Thiry, U.S. Pat. No. 3,434,318; Carter, U.S. Pat. No. 3,782,149; Lehner, U.S. Pat. No. 4,090,379; Sills, U.S. Pat. No. 4,286,445; and Barnard, U.S. Pat. No. 4,317,344. The devices shown in each of these patents are generally restricted to use with a single type of lock and are not readily modified for use with a variety of types of lock. In some of the patents, the lock shield is composed of a generally rigid material that may be difficult or expensive to manufacture. In other instances, some of the prior art devices do not provide complete enclosure for all of the elements of the lock.

SUMMARY OF THE INVENTION

In one embodiment, a lock protector for protecting a lock attached to a hasp comprises a first sheet having a first inner edge and a first perimeter, a second sheet having a second inner edge and a second perimeter, and hinge means connecting the first and second sheets at their inner edges. The first sheet defines a slot adapted to receive the hasp therethrough. Means are included for releasably sealing the first sheet to the second sheet at the first and second perimeters when the first and second perimeters overlap. The said second sheet is adapted to fold over onto the first sheet along the hinge portion to overlap the first and second perimeters and to define an envelope therebetween to enclose the lock when the lock is attached to the hasp and when the hasp is inserted through the slot.

In another embodiment, a lock protector is provided for protecting the key-slot of a lock flush-mounted within a panel. The flush-mounted lock protector includes a first sheet having a first inner edge and a first perimeter, a second sheet having a second inner edge and a second perimeter and hinge means connecting the first and second sheets at their inner edges. An opening is defined in the first sheet configured to permit access to the key-slot when the first sheet is disposed over the flush-mounted lock. Means are provided for releasably sealing the first sheet to the second sheet at the first and second perimeters when the first and second perimeters overlap. The second sheet is adapted to fold over onto the first sheet along the hinge portion to overlap the first and second perimeters so that the second sheet covers the opening in the first sheet, thereby covering the keyhole of the flush-mounted lock.

In yet another embodiment, a lock protector for protecting a lock attached to a hasp is provided which includes a pouch defining a pocket within which the lock can be disposed and a flap extending upwardly from the pouch above the opening of the pocket. A slot is defined in the flap that is adapted to receive the hasp therethrough. The flap further defines a hinge portion which intersects the slot such that when the flap is folded along the hinge portion the slot opens upwardly to receive the hasp and the flap covers the opening of the pocket thereby covering the lock when the lock is attached to the hasp. Means are also provided for releasably engaging the flap to the pouch when the flap is folded along the hinge portion.

It is one object of the invention to provide an improved device for protecting a lock and the keyhole of the lock from the deleterious effect of the weather. It is another object to provide a lock protector that can be used for a variety of types of locks, including padlocks and flush-mounted locks.

Yet another object of the invention is to provide a lock protector that is easily mountable over most types of locks and that provides quick and easy access to the lock without first completely removing the lock protector. Other objects and benefits of the invention can be discerned from the following written description and accompanying figures.

DESCRIPTION OF THE PREFERRED EMBODIMENTS

Figure 1:
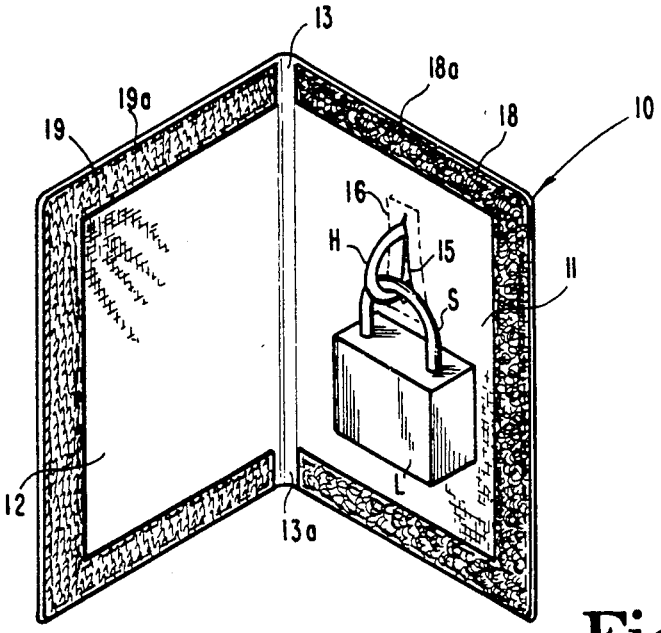
FIG. 1 is a perspective view of one embodiment of the lock protector of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In FIG. 1 a lock protector 10 is illustrated which includes a first sheet or back cover 11, a second sheet or front cover 12, and a hinge portion 13. Preferably, the front and back covers and hinge portion are formed from a single sheet of material that is flexible or bendable, and durable to withstand the effects of the elements such as rain, snow and ice. In one specific embodiment, the lock protector is formed from a sheet of vinyl because the material is flexible yet very durable.

A hasp slot 15 is formed in the back cover 11, displaced slightly off center within the area of the back cover and generally centrally located between the side edge of the back cover and the hinge portion. The back cover 11 is reinforced around the hasp slot 15, such as by stitching 16 in order to prevent the back cover material from tearing or the hasp slot from propagating in the back cover. The stitiching may be eliminated if a material is used that is tear resistant, although in the one specific embodiment using a vinyl material the stitiching can be important to prevent tearing of the material.

The lock protector 10 includes means between the two sheets 11 and 12 for releasably adhering the sheets to form an envelope within which a lock L is contained. In the preferred embodiment, this adhering means includes a contact adherent strip 18 that is stitched by stitching 18A to the outer perimeter of the back cover 11 and a second contact adherent strip 19 that is also stitched by stitching 19A to the outer perimeter of the front cover 12. Alternatively, the contact adherent strips 18 and 19 may include an adhesive backing that will firmly adhere to the front and back covers 11 and 12, in lieu of the stitiching 18A and 19A. In one specific embodiment, the contact adherent strips 18 and 19 are of the mutually pressure adherent type, such as the hook and loop configuration sold under the trade name VELCRO® by Velcro U.S.A., Inc.

In another specific embodiment, the contact adherent strips 18 and 19 may be magnetically adherent strips. One or both of the strips 18 and 19 can be magnetic strips with an adhesive backing for attachment to the respective front and back sheets, while the other of the strips can be a thin strip of metal. In another variation, the means for releasably adhering can include an adhesive layer coating at the perimeter of one or both of the front and back sheets. The adhesive layer can be of the type that permits releasable contact adhesion of the two sheets. Other means for releasably adhering are also contemplated by the present invention, provided the means permits a generally water-tight seal about the perimeter of the two sheets when engaged.

In the use of the lock protector 10 of the present embodiment, a hasp H, which may be part of a mailbox for example, is inserted through hasp slot 15. The material of the back cover 11 between the stitching 16 and the hasp slot 15, yields slightly to conform around the arms of hasp H. With the hasp extending through the hasp slot 15, the shackle S of the lock L can be engaged about the hasp. In some instances, the mailbox may include a pair of hasps, in which case each hasp is inserted through the hasp slot 15 and engaged by the shackle of the lock. With the lock L thus connected about the hasp H, the front cover 12 is folded about the hinge portion 13 so that the contact adherent strips 18 and 19 mutually engage in a firm interlocking engagement.

When it is desired to remove the lock L, the front cover 12 is simply pulled away from the back cover 11 to disengage the contact adherent strips 18 and 19 and expose the lock L. When the lock protector 11 is engaged about the lock, there is extremely limited exposure to the elements outside the lock protector. Any water that may seep through the contact adherent strips or into the hinge portion 13, is readily directed away from the lock L since the hasp slot 15 is generally centrally situated within the area of the back cover. Moreover, since the contact adherent strips terminate at the hinge portion in the preferred embodiment, any water that may accumulate within the closed lock protector will drain through the gap at the lower part 13A of the hinge portion. Alternatively, the contact adherent strips 18 and 19 can extend entirely into the hinge portion, thereby reducing the likelihood that water will enter the lock protector through the gap in the hinge portion.

The lock protector 10 of the preferred embodiment is preferrably composed of a single sheet of a vinyl material. However, other similar flexible yet durable material may be used to form the front and back covers of the lock protector. If the contact adherent strips 18 and 19 each include an adhesive surface it would eliminate the necessity of stitching the material to the front and back covers. For instance, the front cover 12 and back cover 11 may be composed of a single sheet of a flexible and durable plastic.

Figure 2:
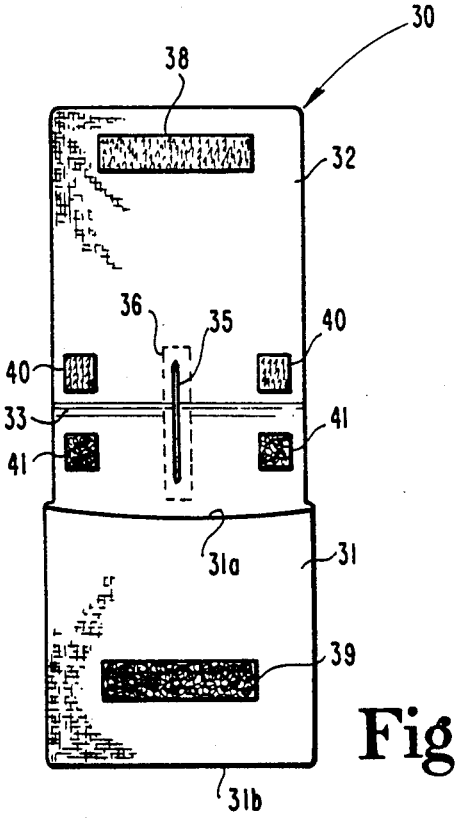
FIG. 2 is a front elevational view of a second embodiment of the present invention.
Figure 2A:
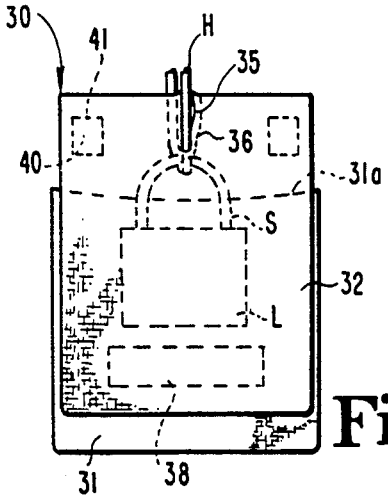
FIG. 2A is a view showing the lock protector of the second embodiment of the invention engaged about a padlock attached to a hasp.

A second embodiment of the present invention is shown with reference to FIGS. 2 and 2A. In this embodiment, a lock protector 30 includes a pouch 31 forming a pocket 31A within which the lock is situated when the lock protector is in use. A flap 32 extends from the top of the back wall of the pouch 31. A hasp slot 35 is formed in the flap 32 with stitching 36 surrounding the slot for reinforcement. The hasp slot 35 is situated on the flap 32 such that the hinge portion 33 of the flap intersects or bisects the hasp slot 35.

The lock protector 30 includes a pair of opposing contact adherent strips 38 and 39, one of the strips 38 being situated on the flap while the other of the strips 39 is situated on the front wall of the pouch 31. A second set of contact adherent strips 40 and 41 are situated on opposite sides of the hinge portion 33 on the flap 32. When the flap 32 is folded over along the hinge portion 33, the contact adherent strips 38 and 39 engage to attach the flap to the pouch, while the contact adherent strips 40 and 41 engage about the hinge portion 33. In most respects, the lock protector 30 is similar to the lock protector 10 in that the same materials may be used to form the pouch and flap and the same types of contact adherent strips may be used to close the lock protector. The contact adherent strips may also be of the magnetically adherent or releasable adhesive type described above.

In use, the lock protector 30 is particularly suited for a vertically situated hasp H, such as is shown in FIG. 2A. In this instance, the hasp is inserted through the hasp slot 35 and the shackle S of the lock L is engaged about the hasp. With the lock L situated within the pocket 31A, the flap 32 is then folded over the shackle S and engaged on the pouch 31 to close the pocket 31A with the lock L therein.

In the illustrated embodiments of the lock protector 30, a certain region surrounding the contact adherent strips 40 and 41 is open, thereby providing access for the elements, such as water, to the pocket 31A. In this instance, the base sheet 31 of the pouch 31 may be provided with a number of holes at the bottom edge 31B to permit drainage of any water that may collect within the pocket 31A.

Figure 3:
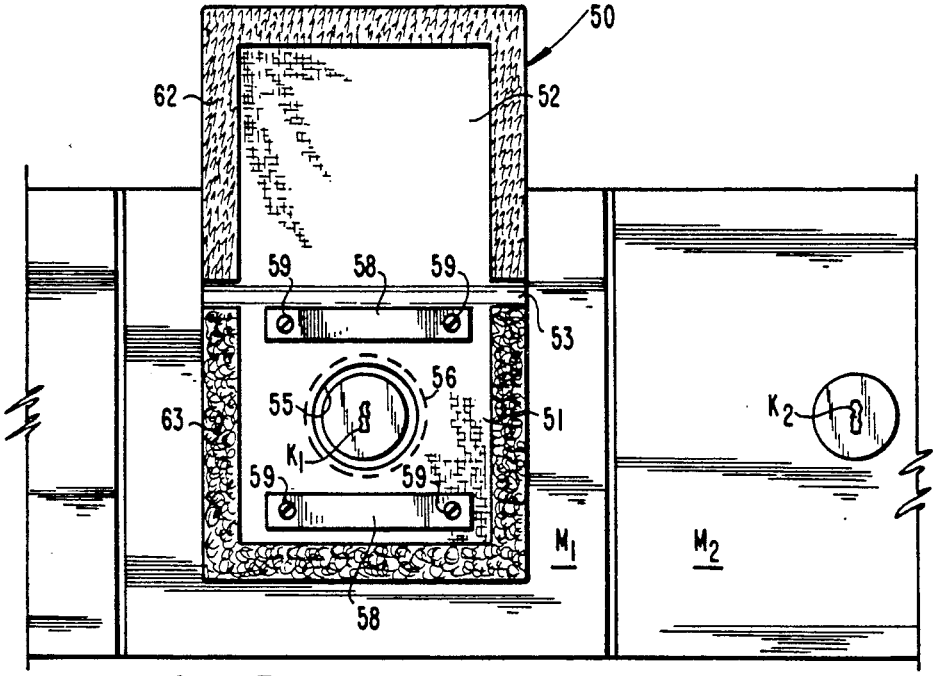
FIG. 3 is a front elevational view of a third embodiment of the lock protector of the present invention.

In another embodiment of the present invention, a lock protector 50 is adapted for covering a flush mounted lock, such as a cylinder lock frequently used on a mail box array having mail boxes $M_1$, $M_2$, etc. In this embodiment, the lock protector 50 includes a base sheet 51 and a flap 52 which is joined to top edge of the base sheet 51 by a hinge portion 53. As with the two previous embodiments, the base sheet, flap and hinge portion may be composed of a single sheet of material, such as a vinyl. The base sheet 51 includes an access opening 55 surrounded by reinforcement stitching 56. The access opeining in the specific embodiment shown in FIG. 3 is circular to conform to the circular configuration of the cylinder lock $K_1$. Alternatively, the access opening 55 can assume whatever shape is necessary to provide clear access to the keyhole of the flush mounted lock K.

In the embodiment of FIG. 3, a pair of mounting plates 58 are attached to the base sheet 51, one of the plates being adjacent the lower portion of the base sheet while the other of the plates is adjacent the hinge portion 53. The mounting plates 58 are provided with spaced apart holes through which a number of mounting screws 59 pass for threading through the base sheet 51 and into the mailbox $M_1$. Alternatively, the screws 59 may be bolts, rivets, or other rigid fasteners, provided they are sufficiently strong to attach the lock protector 50 to the wall of the mailbox $M_1$. The mounting plates 58 are preferably adhered to the base sheet. However, the plates 58 may be connected to the base sheet by way of the screws 59 only. In the preferred embodiment, the plates 58 are composed of a thin strip of stainless steel, although other materials may be equally suited to attach the lock protector 50 to the mailbox $M_1$.

The lock protector 50 includes contact adherent strips 62 and 63 attached to the base sheet 51 and flap 52, respectively. The contact adherent strips 62 and 63 may assume any of the variations described for the previous embodiments and may be affixed to the base and flap as previously described.

Figure 4:
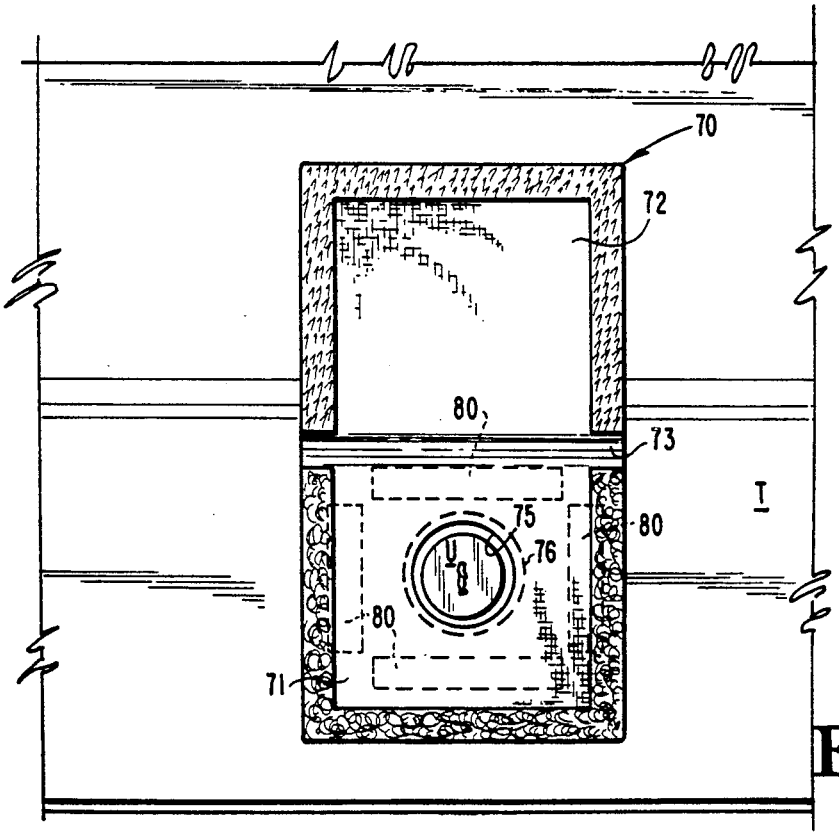
FIG. 4 is a front elevational view of a fourth embodiment of the present invention.

Another embodiment of the invention resides in a lock protector 70 shown in FIG. 4, which is a variation of the lock protector 50. This lock protector 70 is well-suited for use on surfaces that are not readily adapted for a permanent connection of the lock protector. The lock protector 70 includes a base sheet 71 and a flap 72 that are connected by a hinge portion 73, which are in all relevant aspects identical to the base sheet, flap and hinge portion of the previous embodiment. The base sheet 71 includes an access opening 76 to provide access to a lock U, which in the illustrated embodiment is a lock for a trunk T of an automobile. In this instance, it is not desirable to have the lock protector 70 permanently fixed to the trunk by way of a rigid fastener. Thus, the lock protector 70 includes a number of magnetic strips 80 which are affixed to the under-side or back of the base 71. The magnetic strips are preferably strong enough to magnetically adhere to the metallic trunk T and remain in position surrounding the lock U even while the vehicle is moving.

In using the lock protectors 50 and 70 which are suitable for use with a flush mounted lock, such as locks K and U, the lock protector is situated with the access opening centered over the particular lock. The flaps 52 and 72 are folded over at the hinge portions 53 and 73, respectively, so that the contact adherent strips of each of the lock protectors mutually engage to seal the perimeter of the lock protector 50 or 70 around the flush mounted lock K or U.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A lock protector for protecting a lock having a shackle attached to a hasp comprising:

a first sheet portion having a first inner edge and a first perimeter;

a second sheet portion having a second inner edge and a second perimeter;

a hinge portion connecting the first and second sheet portions at said first and second inner edges;

said first sheet portion defining a slot, said slot being sized to receive the hasp therethrough in close fit relation; and means for releasably sealing said first sheet portion to said second sheet portion substantially along the entire length of said first and second perimeters when said first and second perimeters overlap;

wherein said second sheet portion is adapted to fold over onto said first sheet portion along said hinge portion to overlap said first and second perimeters and to define an envelope therebetween to substantially completely enclose the lock and its shackle when the shackle is attached to the hasp and when the hasp is inserted through said slot.

2. The lock protector of claim 1 wherein said first sheet portion, said second sheet portion and said hinge portions are formed from a single sheet of material.

3. The lock protector of claim 2 wherein said single sheet of material is composed of vinyl.

4. The lock protector of claim 1 wherein said first sheet portion includes reinforcement means surrounding said slot to prevent said first sheet portion from tearing at said slot.

5. The lock protector of claim 1 wherein said means for releasably sealing includes contact adherent means between and substantially along the entire length of said first and second perimeters for releasably adhering said first sheet portion to said second sheet portion when said first and second perimeters contact each other.

6. The lock protector of claim 5, wherein said contact adherent means includes a pair of mutually pressure adherent hook and loop configured strips, one each of said strips being attached to a respective one of said first and second sheet portions.

7. The lock protector of claim 5 wherein said contact adherent means includes a pair of magnetically adherent strips, one each of said strips being attached to a respective one of said first and second sheet portions.

8. A lock protector for protecting the key-slot of a lock flush-mounted within a panel comprising:

a first sheet portion having a first inner edge and a first perimeter;

a second sheet portion having a second inner edge and a second perimeter;

a hinge portion connecting the first and second sheet portions at said first and second inner edges;

said first sheet portion defining an opening adapted to permit access to the key-slot when said first sheet portion is disposed over the flush-mounted lock; and means for releasably sealing said first sheet portion to said second sheet portion substantially along the entire length of said first and second perimeters when said first and second perimeters overlap, said means for releasably sealing including contact adherent means between and substantially along the entire length of said first and second perimeters;

wherein said second sheet portion is adapted to fold over onto said first sheet portion along said hinge portion to overlap said first and second perimeters so that the second sheet portion covers said opening in said first sheet portion, thereby covering the keyhole of the flush-mounted lock; and wherein said first sheet portion, second sheet portion and said hinge portion are formed from a single sheet of material.

9. The lock protector of claim 8 wherein said single sheet of material is composed of vinyl.

10. The lock protector of claim 8 wherein said first sheet portion includes reinforcement means surrounding said opening to prevent said first sheet portion from tearing at said opening, said reinforcement means including stitching sewn into said first sheet portion.

11. The lock protector of claim 8 further comprising means for attaching the lock protector to the panel within which the lock is flush-mounted.

12. The lock protector of claim 11 wherein said means for attaching includes:

a number of magnetic strips affixed to said first sheet portion and adapted to magnetically engage the panel.

13. A lock protector for protecting the key-slot of a lock flush-mounted within a panel comprising:

a first sheet portion having a first inner edge and a first perimeter;

a second sheet portion having a second inner edge and a second perimeter;

a hinge portion connecting the first and second sheet portions at said first and second inner edges;

said first sheet portion defining an opening adapted to permit access to the key-slot when said first sheet portion is disposed over the flush-mounted lock;

means for releasably sealing said first sheet portion to said second sheet portion at said first and second perimeters when said first and second perimeters overlap; and means for attaching the lock protector to the panel within which the lock is flush-mounted, said means for attaching including;

a number of mounting plates affixed to said first sheet portion; and a number of fasteners adapted to fasten said number of mounting plates to the panel;

wherein said second sheet portion is adapted to fold over onto said first sheet portion along said hinge portion to overlap said first and second perimeters so that the second sheet portion covers said opening in said first sheet portion, thereby covering the keyhole of the flush-mounted lock; and wherein said first sheet portion, second sheet portion and said hinge portion are formed from a single sheet of material.

14. A lock protector for protecting a lock having a shackle attached to a hasp comprising:

a pouch defining a pocket within which the lock can be disposed;

a flap extending upwardly from said pouch above the opening of said pocket;

said flap defining a slot sized to receive the hasp therethrough in close fit relation;

said flap further defining a hinge portion which intersects said slot such that when said flap is folded along said hinge portion said slot opens upwardly to receive the hasp and the flap covers the opening of said pocket thereby covering the lock and its shackle when the shackle is attached to the hasp; and means for releasably engaging said flap to said pouch when said flap is folded along said hinge portion.

15. The lock protector of claim 14 wherein the lock protector is composed substantially of vinyl.

16. The lock protector of claim 14 wherein said flap includes reinforcement means surrounding said slot to prevent said flap from tearing at said slot.

17. The lock protector of claim 14, wherein said means for releasably engaging includes opposing contact adherent means between said flap and said pouch.

18. Said lock protector of claim 17 wherein said means for releasably engaging includes second contact adherent means situated above and below said hinge portion and adapted to be releasably mutually engaged about said hinge portion when said flap is folded over the opening of said pocket.

* * * * *